United States Patent [19]

Bochan

[11] 4,193,275

[45] Mar. 18, 1980

[54] AGITATOR MECHANISM FOR CLOTHES WASHING MACHINE

[75] Inventor: John Bochan, Louisville, Ky.

[73] Assignee: General Electric Company, Louisville, Ky.

[21] Appl. No.: 965,803

[22] Filed: Dec. 4, 1978

[51] Int. Cl.[2] ..... D06F 17/06; D06F 17/10

[52] U.S. Cl. ..... 68/134; 68/131

[58] Field of Search ..... 68/133, 134, 131, 23.6, 68/23.7, 53, 54

[56] References Cited

U.S. PATENT DOCUMENTS

| | | | |
|---|---|---|---|
| 1,894,178 | 1/1933 | Kitts | 68/131 |
| 2,142,961 | 1/1939 | Kuhn | 8/139 |
| 2,502,702 | 4/1950 | Castner | 68/134 |
| 2,584,291 | 2/1952 | Rand | 68/21 |
| 2,770,118 | 11/1956 | Walton | 68/53 X |
| 3,010,303 | 11/1961 | Bochan | 68/131 X |
| 3,071,955 | 1/1963 | Platt et al. | 68/53 |
| 3,132,500 | 5/1964 | Bullock | 68/134 X |
| 3,245,235 | 4/1966 | Long | 68/131 X |
| 3,648,487 | 3/1972 | Hoffman | 68/23.6 X |
| 3,678,714 | 7/1972 | Krolzick | 68/131 |

*Primary Examiner*—Philip R. Coe

*Attorney, Agent, or Firm*—Bruce A. Yungman; Radford M. Reams

[57] ABSTRACT

An agitator for a clothes washing machine including a center post extending into the clothes receiving receptacle and upon which is mounted a vertically reciprocable agitator member including an agitator element extending radially outward from the center post. The agitator element is mounted on a nut member which mates with a thread formed on the center post, such that upon relative rotation between the agitator element and the center post, vertical reciprocation of the agitator element takes place to induce turnover motion of the clothes. The center post is oscillated to cause the reciprocation by engagement of the agitator element with clothes disposed in the machine during the wash cycle. The agitator element is configured with a downwardly extending flared skirt portion having scalloped edges to increase the interengagement with the clothes. The flared shape of the agitator element causes a net downward force on the clothes drawing them downwardly along the center post. The agitator in one version also includes radial vanes located on an agitator bell portion integral with the center post or, alternatively, a plurality of agitator skirt elements are provided without the provision of the agitator radial vanes. The agitator skirt elements may also be perforated to produce a water surging action.

10 Claims, 3 Drawing Figures

AGITATOR MECHANISM FOR CLOTHES WASHING MACHINE

BACKGROUND DISCUSSION

In typical clothes washing machines, there is provided a clothes receiving receptacle such as a perforate basket or tub within which is disposed an agitator, the agitator oscillated to produce the clothes washing action. Such agitator generally consists of a center post extending upwardly into the receptacle with vanes from the center post extending radially outward on a lower bell portion of the agitator.

Such agitators do not for the most part exhibit good turnover capability, i.e., the ability to create a toroidal circulation of the clothes due to the generally mediocre performance of such agitators in forcing the clothes downwardly along the center post.

There has thus heretofore been provided a variety of arrangements for producing a vertical movement of an impeller or agitator which tends to force the clothes downwardly into the receptacle in the center region of the basket and to set up the toroidal motion and consequent turnover of the clothes.

This turnover motion is desirable for good washing action inasmuch as it presents varying clothes surfaces for scrubbing action against each other and the surfaces of the basket and the agitator. In addition, the rollover allows the heavy solid particles to be settled out and collected in the lower region of the tub or basket.

In some washing machines, the agitator consists of an agitator mechanism in which tapering skirt elements are caused to be reciprocated. Such skirt elements are generally frusto-conical in shape and may be upwardly or downwardly directed and are caused to be reciprocated by a relatively complex transmission. Such machines are normally less durable and reliable than oscillating agitators, and tend to be more costly to manufacture.

Examples of these machines are disclosed in U.S. Pat. Nos. 2,584,291; 3,010,303; 3,197,791; 3,245,235 and 3,648,487.

In U.S. Pat. No. 3,678,714, there is disclosed an arrangement whereby a conventional oscillating agitator is provided with a reciprocating agitator device on the upper region of the agitator post, which reciprocation is produced by the oscillation of the agitator by a cam arrangement affixed to the basket to be relatively stationary during oscillation of the agitator, with the interreaction of the relatively stationary cam and a cam carried by the reciprocating mechanism resulting in vertical reciprocation of an agitator element, thereby improving the rollover characteristics of the agitation action.

While this is simpler than the aforementioned vertical reciprocation type washing machines, this arrangement is still relatively complex and a costly addition to the machine.

Accordingly, it is an object of the present invention to provide an agitator mechanism which affords good turnover agitation action without entailing complex mechanical components in order to achieve vertical reciprocation of an agitator element.

It is another object of the present invention to provide an agitation mechanism which is readily utilized in conjunction with a conventional oscillating agitator having radially extending vane portions thereon, or which may be employed without such conventional vaning.

SUMMARY OF THE INVENTION

These and other objects of the present invention, which will become apparent upon a reading of the following specification and claims, are achieved by an agitator arrangement including a center post which is adapted to be oscillated by a conventional oscillator transmission. An agitator element is mounted for relative rotation with respect to the center post having radially outwardly extending portions relative the center post. The agitator element is supported for relative rotation by means of camming surfaces such as mating thread forms, which produce relative axial movement between the center post and the agitator element upon relative rotation between. The agitator element is restrained against rotation by engagement with the clothes in the load during wash and rinse cycles such that as the center post is oscillated, a vertical reciprocation of the agitator element is produced by the center post oscillation. The vertically reciprocated agitator element may be employed in conjunction with a conventional vane structure disposed on the agitator post or a plurality of the agitator plunger elements may be employed without such vaning.

In the preferred embodiment, the agitator element consists of a frusto-conical downwardly directed flared skirt, the outer edge of which is scalloped to enhance the interengagement with the fabric items in the wash load. The agitator elements may be perforated in order to produce a water surging action to further improve the load agitation.

DETAILED DESCRIPTION

Figure 1:
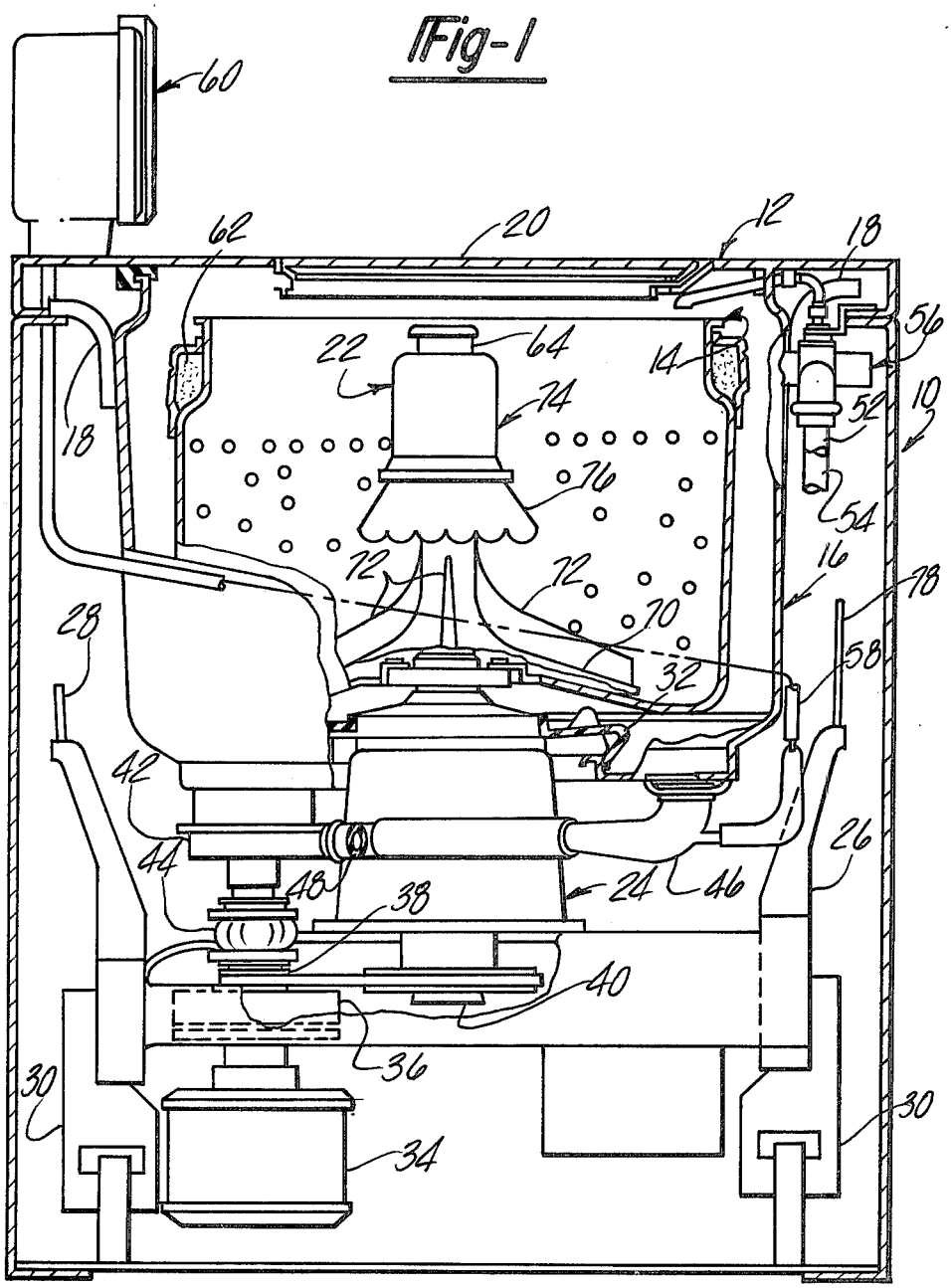
FIG. 1 is a side elevational view of a clothes washing machine shown in partial section depicting the agitator mechanism according to the present invention.

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings, a clothes washing machine 10 according to the present invention is depicted, which includes an outer cabinet 12 within which is mounted a perforated clothes receiving receptacle or basket 14 which is in turn received within an outer tub 16 in nesting relationship. The outer tub 16 is mounted directly to the cabinet frame by means of straps 18 thereto. A top access door 20 is provided in order to provide access to the interior of the basket 14 for adding the clothing items to be washed as well as the detergent and other washing additives.

An agitator mechanism 22 is disposed in the interior of the basket 14 for the purpose of causing agitation of the washing solution and the clothes load in order to carry out the washing and rinsing actions. The agitator mechanism 22 and the basket 14 are mounted on the housing of a transmission 24 which houses various transmission components.

The transmission 24 in turn is mounted on a suspension frame 26 which is suspended by tie rods 28 to the machine frame. These tie rods are secured by ball joints in a known fashion to the machine frame. Damper pads 30 are also provided to stabilize the suspension frame 26.

A sealing boot 32 is provided between the outer tub 16 bottom and the exterior of the transmission 24 to seal the bottom therebetween while accommodating the relative movement required due to vibration and excursionary movement of the basket 14 and suspended componentry which occurs during high speed spin of the basket 14 during the conventional extraction cycle.

As per conventional practice, the washing action is carried out by movement of the clothes load and the washing solution induced by an agitator mechanism 22, with the spin dry or extraction cycle carried out by a relatively high speed rotation of the basket 14.

The drive of the agitator mechanism 22 and the spin of the basket 14 are both achieved by a drive motor 34 supported on suspension frame 26, acting through a two-speed clutch 36 and a pulley 38 to drive the input member 40 to the transmission 24.

The transmission 24 may be of a known type which produces, in a first direction of rotation of the drive motor 34, an oscillation of the agitator mechanism 22 and, in the reverse direction of driving rotation, produces the high speed direct drive of the basket 14.

Such drive means is disclosed in U.S. Pat. No. 2,844,225 to Hubbard et al and assigned to the same assignee as the present application. This patent discloses in detail the structural characteristics of a transmission assembly suitable for use in the illustrated machine.

The two-speed clutch 36 is also of a known design, details of the same being disclosed in U.S. Pat. No. 2,869,699 to Bochan, also assigned to the assignee of the present application.

The drive motor 34 is also adapted to drive a drain pump 42 secured to the output of the motor 34 by means of a flexible coupling 44. The water collected in the outer tub 16 is drained through a drain fitting 46 and pumped outwardly through a drain hose 48 depicted partially in FIG. 1 to an external plumbing drain (not shown).

Water is aded to the machine via inlet lines 52 and 54 from hot and cold water supplies directed into the outer tub 16 and the basket 14 via solenoid operated fill valves 56 in the conventional fashion, with the volume of water aded under control of a pressure sensing tab 58, establishing a predetermined level of water in the outer tub 16 for each wash and rinse cycle.

The various water level, cycle and speed control components are housed in a control panel 60 in conventional fashion.

The basket 14 may be provided with a balancing ring 62 filled with a heavy granular material such as magnetite to minimize the excursion of basket 14 due to the uneven distribution of the clothes load in the high speed spin cycle.

Many other details of the clothes washing machine 10 are here omitted inasmuch as they do not form a part of the present invention and are well known to those skilled in the art.

The agitator mechanism 22, according to the present invention, comprises an agitator center post 64 which extends vertically upwardly into the central region of the basket 14 and is adapted to be driven by an agitator drive shaft 66 (FIG. 2), which extends upwardly in the interior of the agitator center post 64 and a splined connection at 68 establishes a rotative connection therebetween. The agitator drive shaft 66 is adapted to be oscillated by the transmission 24 in the known manner.

The agitator center post 64 may be integrally formed with a bell portion 70 in which are integrally formed vanes 72 which extend radially outward from the agitator center post 64 and serve to establish outward circulation and agitation of the washing solution, as well as radially outward movement of the clothes items in the load, such as to tend to establish the toroidal movement described above.

Figure 2:
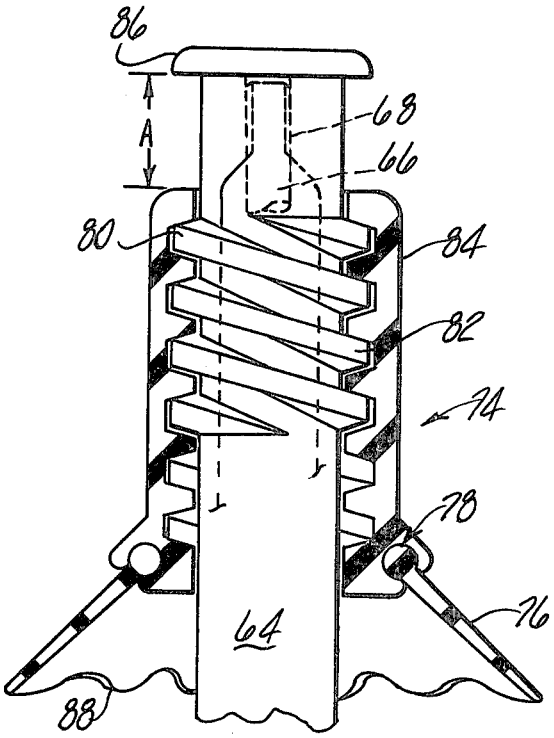
FIG. 2 is an enlarged partially sectional view of the agitator mechanism shown in FIG. 1.

The agitator mechanism 22 also includes a vertical reciprocation agitator member 74 which is mounted to the agitator center post 64 in the embodiment of FIGS. 1 and 2 in the upper region of the basket 14. The vertical reciprocation agitator member 74 includes a sleeve 84 and an agitator skirt element 76 which may be constructed of a flexible material such as an elastomer, and which extends radially outward and downward from the agitator center post 64. The agitator skirt element 76 is received within a groove 78 formed in the sleeve 84 to be mounted thereto.

The agitator skirt element 76 may also be of a rigid material such as polypropylene.

The vertical reciprocation agitator member 74 is mounted on the agitator center post 64 by means which freely allows relative rotation therebetween, but which relative rotation, when occurring, produces relative axial movement of the vertical reciprocation agitator member 74 on the agitator center post 64. This means consists of cooperating camming surfaces fixed respectively to the vertical reciprocation agitator member 74 and the agitator center post 64.

The cam surfaces in the embodiment depicted consist of an external thread 80 molded into the exterior of the agitator center post 64 and an internal thread 82 formed in the sleeve 84.

The axial length of the internal thread 82 is somewhat greater than the length of the external thread 80 formed on the agitator center post 64 to accommodate a limited extent of axial movement as indicated at A between the uppermost end surface of the sleeve 84 and a cap 86 formed on the agitator center post 64. The vertical reciprocation agitator member 74 is depicted in FIG. 2 in the down position.

The sleeve 84 is relatively rotatable with respect to the agitator center post 64 and relative rotation therebetween is induced by interengagement of the agitator skirt element 76 with the relatively stationary clothing items contained in the load.

In order to increase the engagement interaction between the lower edge of the agitator skirt element 76 and the clothing items, the lower edge 88 is preferably scalloped as shown in FIG. 2 or otherwise contoured.

Accordingly, upon oscillation of the agitator center post 64 and the agitator skirt element 76 being maintained substantially stationary by the rotative restraint exerted by the clothing items, a vertical reciprocation along the axis of the agitator center post 64 will result. The downwardly flaring configuration of the agitator skirt element 76 produces a net downward force on the clothing items since the agitator skirt element 76 is streamlined as it moves upwardly, allowing the clothes to slip over the lower scalloped edge 88, whereas they are engaged by the lower edge 88 during downward movement such that net downward circulation of the clothing items along the agitator center post 64 axis results.

Some rotation of the agitator skirt element 76 would usually occur, but this tends to increase the agitation of the clothes.

The fabric items are circulated to the down post position and come into engagement with the vanes 72 and are circulated outwardly in the basket 14 by circulation of washing solution, as well as direct engagement with the vanes 72 to thus establish the toroidal flow as the clothing items are moved outwardly and upwardly along the wall of the basket 14.

Figure 3:
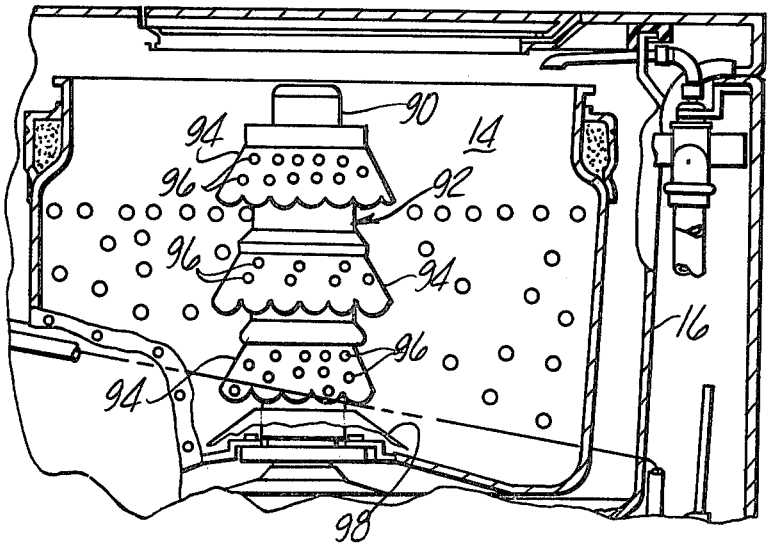
FIG. 3 is a side elevational view of a portion of the clothes washing machine incorporating an alternate embodiment of the agitator mechanism according to the present invention.

Alternatively, as depicted in FIG. 3, a plurality of agitator skirt elements 76 may be incorporated to dispense with the need for the vanes 72. In this case, the agitator center post 90 extends straight downwardly without the bell portion as in the above-described embodiment. The agitator mechanism 92 incorporates three levels of agitator skirt elements 94 spaced along the agitator center post 90, such that the agitation is produced solely by reciprocation of the agitator skirt elements 94 achieved by oscillation of the agitator center post 90 to thus produce a low cost reciprocating mechanism. A conical cover 98 is also provided to cover the bottom flange and attachment fasteners to prevent snagging of the clothing items.

The agitator skirt elements 94 may also be perforated at 96 which will create a water surging action as the skirt element is reciprocated, to enhance the clothes washing action.

Accordingly, it can be seen that a relatively simple and low cost mechanism has been provided to produce a vertical up and down or reciprocatory agitation action which employs a conventional transmission commonly utilized in conventional washing machine designs and which will operate in a highly reliable manner to produce good circulation of the fabric or clothing items in the clothes washing receptacle.

The embodiments of the invention in which an exclusive property or privilege is claimed are defined as follows:

1. A washing machine comprising:

a clothes washing receptacle mounted in an upright position;

means for introducing a washing solution into said clothes washing receptacle;

an agitator mechanism including:

an agitator center post extending upwardly into the interior of said clothes receiving receptacle;

a vertical reciprocation agitator member;

means mounting said vertical reciprocation agitator member so as to be freely rotatable relative to said agitator center post, said vertical reciprocation agitator member including an agitator element extending radially outwardly from said agitator center post;

said means mounting said vertical reciprocation agitator member on said agitator center post including interengaging cam surfaces fixed to said agitator center post and said vertical reciprocation agitator member, respectively, causing relative axial movement in either direction between said vertical reciprocation agitator member and said agitator center post upon relative rotation therebetween in either direction; and means for oscillating said agitator center post, whereby interengagement between clothing items and said agitator element causes relative rotation between said vertical reciprocation agitator member and said agitator center post, whereby said vertical reciprocation thereof will occur to produce agitation of said clothes load in said washing solution to carry out said washing action.

2. The clothes washing machine according to claim 1 wherein said interengaging cam surfaces consist of cooperating thread forms.

3. The clothes washing machine according to claim 2 wherein said vertically reciprocable agitator member includes a sleeve being formed with one of said thread forms and wherein said agitator center post is formed with an external thread form mating with said internal thread form formed on said agitator sleeve.

4. The clothes washing machine according to claim 3 wherein said sleeve is formed with an internal thread of longer length than said external thread formed on said agitator center post and further including means limiting the relative extent of axial movement therebetween.

5. The clothes washing machine according to claim 1 wherein said agitator element consists of a flexible skirt element which extends relatively downwardly and radially outwardly.

6. The clothes washing machine according to claim 5 wherein said flexible skirt element is formed with a scalloped edge along its lower peripheral edge thereof to increase the interengagement between said clothes items and said flexible skirt element to increase the relative restraint of rotation thereof.

7. The clothes washing machine according to claim 6 wherein said flexible skirt element is perforated to produce a water surging action upon said vertical reciprocation thereof.

8. The clothes washing machine according to claim 1 wherein said agitator mechanism further includes agitator vanes formed along the lower portion of said agitator center post below said vertically reciprocable agitator member.

9. The clothes washing machine according to claim 1 wherein said vertical reciprocation agitator member further includes a plurality of axially spaced agitator elements.

10. The clothes washing machine according to claim 9 wherein each of said agitator elements consists of a flexible skirt element which extends relatively downwardly and radially outwardly.

* * * * *